US007475539B2

(12) United States Patent
Chen

(10) Patent No.: US 7,475,539 B2
(45) Date of Patent: Jan. 13, 2009

(54) INCLINED RIB PORTED SHROUD COMPRESSOR HOUSING

(75) Inventor: Hua Chen, Blackburn (GB)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/440,308

(22) Filed: May 24, 2006

(65) Prior Publication Data

US 2007/0271921 A1 Nov. 29, 2007

(51) Int. Cl.
*F04D 27/02* (2006.01)

(52) U.S. Cl. ..... 60/597; 415/144; 415/914; 415/57.3; 415/58.4

(58) Field of Classification Search ..... 417/406–409; 415/144, 914, 57.1, 57.3–57.4, 58.2–58.4; 60/597, 602

See application file for complete search history.

(56) References Cited

U.S. PATENT DOCUMENTS

| | | | | |
|---|---|---|---|---|
| 4,375,938 | A * | 3/1983 | Dussourd | 415/58.4 |
| 4,479,755 | A * | 10/1984 | Skoe | 415/144 |
| 4,531,356 | A | 7/1985 | Linder | |
| 4,930,979 | A * | 6/1990 | Fisher et al. | 415/58.4 |
| 4,990,053 | A * | 2/1991 | Rohne | 415/58.4 |
| 5,246,335 | A * | 9/1993 | Mitsubori et al. | 415/58.3 |
| 5,282,718 | A * | 2/1994 | Koff et al. | 415/57.3 |
| 5,295,785 | A | 3/1994 | Church et al. | |
| 5,308,225 | A * | 5/1994 | Koff et al. | 415/57.3 |
| 5,333,990 | A * | 8/1994 | Foerster et al. | 415/58.4 |
| 5,863,178 | A * | 1/1999 | Scheinert et al. | 415/58.4 |
| 6,196,789 | B1 * | 3/2001 | McEwen et al. | 415/58.4 |
| 6,623,239 | B2 | 9/2003 | Sahay et al. | |
| 7,083,379 | B2 * | 8/2006 | Nikpour et al. | 415/58.4 |
| 2005/0163606 | A1 * | 7/2005 | Svihla et al. | 415/58.4 |

FOREIGN PATENT DOCUMENTS

| | | |
|---|---|---|
| DE | 19823274 | 10/1999 |
| DE | 10223876 | 12/2003 |
| EP | 1143149 | 3/2001 |
| WO | 9402742 | 2/1994 |

OTHER PUBLICATIONS

S. Yamaguchi, H. Yamaguchi, S. Goto, H. Nakao, and F. Nakamura, The development of effective casing treatment for the turbocharger compressors, IMechE, 2002, pp. 23-32.
Honeywell PCT ISR PCT/US2007/069339.

* cited by examiner

*Primary Examiner*—Thomas E Denion
*Assistant Examiner*—Mary A Davis
(74) *Attorney, Agent, or Firm*—John Griecci

(57) ABSTRACT

A turbocharger system having a compressor housing containing a rotating compressor wheel with a plurality of impellers that define an impeller passageway from an inducer to an exducer. The compressor housing includes an annular upstream housing-portion forming an upstream shroud-wall, and a downstream housing-portion forming a downstream shroud-wall. The a rib supports the upstream housing-portion with respect to the downstream housing-portion such that they are respectively disposed to form an annular bypass port into the impeller passageway between the upstream and downstream shroud-walls. The rib extends along a non-axial path within the bypass passageway.

10 Claims, 8 Drawing Sheets

INCLINED RIB PORTED SHROUD COMPRESSOR HOUSING

The present invention relates generally to compressors for turbomachinery and, more particularly, to apparatus and methods of recirculating air in a compressor chamber.

BACKGROUND OF THE INVENTION

Rotary compressors are used in a variety of applications for compressing gases. As an example, with reference to FIG. 1, in turbocharger technology a rotating compressor wheel 11 within a compressor housing 13 sucks air through an intake port 15, compresses it in an impeller passage 17, and diffuses it into a volute 19. The compressed air is supplied to an intake manifold of an internal combustion engine. The operating range of a compressor extends from a surge condition (wherein the airflow is "surging"), occurring at low airflow rates, to a choke condition (wherein the airflow is "choking") experienced at high airflow rates. Surging airflow occurs when a compressor operates at a relatively low flow rate with respect to the compressor pressure ratio, and the resulting flow of air throughout the compressor becomes unstable. "Choking" occurs when a compressor tries to operate at a high flow rate that reaches the mass flow rate available through the limited area of an intake end of the compressor wheel (known as the inducer) through which air arrives at the compressor wheel.

In order to improve the operating flow range, some compressors include one or more bypass ports 21 (such as in the form of an annular opening) on a compressor housing inner wall 23 (also referred to as a shroud) of the impeller passage 17 surrounding the compressor wheel 11. This "ported shroud" forms a bypass passageway 25 that extends between the bypass port(s) and a substantially annular opening 27 into the intake port 15 that feeds air in to the impeller passage. The ported shroud thus creates a second passage connecting the intake port to the impeller passage, wherein this second passage does not extend through the inducer.

The ported shroud typically improves the surge characteristics of a compressor by rerouting some air passing through the impeller passage back to the intake port during low-airflow operation, thereby extending the range over which the compressor can operate without experiencing a surge condition. The ported shroud may improve the choke characteristics of a compressor by providing an additional flow path into the impeller passage that does not extend through the inducer during high-airflow operation. This extends the range over which the compressor can operate without experiencing a choke condition.

When the bypass port 21 is in the form of an annular opening, it is necessary to have support structure to hold an upstream portion 31 of the compressor, which forms the portion of the compressor housing inner wall that is upstream from the bypass port, with respect to a downstream portion 33 of the compressor, which forms the portion of the compressor housing inner wall that is downstream from the bypass port. This support structure is typically a plurality of radial ribs 35 extend axially through the bypass passageway 25.

Airflow received through the bypass port 21 from the impeller passage 17, i.e., bypass air, typically has a flow vector including both a substantial axial component (i.e., a component of flow direction through the bypass passageway 25 and parallel to the compressor wheel axis of rotation) and a substantial circumferential component (i.e., a component of flow direction tangent to the circumference of the bypass passageway at that location). The circumferential component may be useful in reducing the angle of incidence between air passing through the bypass passageway and external air initially entering the compressor housing. Radial ribs that extend axially through the bypass passageway guide the airflow in an axial direction, obstruct the circumferential component of the airflow, and therefore reduce the circumferential component of the flow vector.

Accordingly, there has existed a need for an apparatus and related methods to extend the flow range of a compressor without reducing the circumferential component of the bypass air. Moreover, it is preferable that such apparatus are cost and weight efficient. Preferred embodiments of the present invention satisfy these and other needs, and provide further related advantages.

SUMMARY OF THE INVENTION

In various embodiments, the present invention solves some or all of the needs mentioned above, typically providing a turbocharger system that can extend the flow range of a compressor without introducing significant inefficiencies from reducing the circumferential component of the bypass air.

The invention typically provides a compressor housing configured to contain a rotating compressor wheel with a plurality of impellers that define an impeller passageway from an inducer to an exducer, through which the plurality of impellers are configured to rotate. The invention typically includes an annular upstream housing-portion forming an upstream shroud-wall substantially conforming to an upstream portion of the impeller passageway, and a downstream housing-portion forming a downstream shroud-wall substantially conforming to a downstream portion of the impeller passageway.

The invention typically features a rib supporting the upstream housing-portion with respect to the downstream housing-portion such that they are respectively disposed to form an annular bypass port into the impeller passageway between the upstream and downstream shroud-walls, the rib extending along a non-axial path within the bypass passageway. Advantageously, this feature generally provides for lower noise and vibration levels related to the obstruction of non-axial surge airflow, and/or a related improvement in the flow range of the compressor.

Other features and advantages of the invention will become apparent from the following detailed description of the preferred embodiments, taken with the accompanying drawings, which illustrate, by way of example, the principles of the invention. The detailed description of particular preferred embodiments, as set out below to enable one to build and use an embodiment of the invention, are not intended to limit the enumerated claims, but rather, they are intended to serve as particular examples of the claimed invention.

DETAILED DESCRIPTION OF THE PREFERRED EMBODIMENTS

The invention summarized above and defined by the enumerated claims may be better understood by referring to the following detailed description, which should be read with the accompanying drawings. This detailed description of particular preferred embodiments of the invention, set out below to enable one to build and use particular implementations of the invention, is not intended to limit the enumerated claims, but rather, it is intended to provide particular examples of them.

Typical embodiments of the present invention reside in a ported compressor housing for a turbocharger, along with associated methods and apparatus. Preferred embodiments of the invention are assemblies that provide for an annular ported shroud supported by ribs that do not significantly obstruct a circumferential component of bypass airflow.

Figure 1:
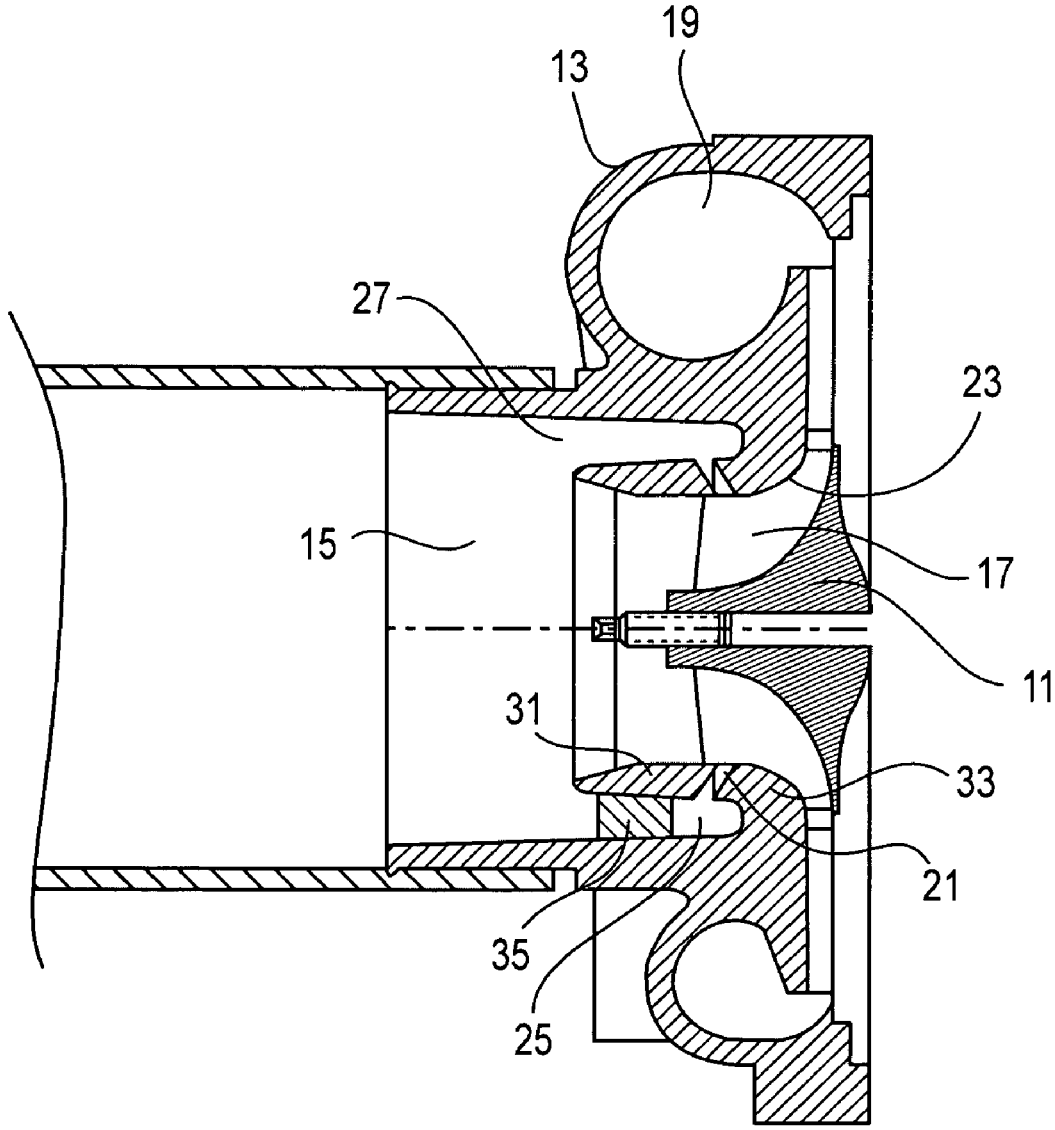
FIG. 1 PRIOR ART
FIG. 1 is a cross-section of a Prior Art compressor housing.
Figure 2:
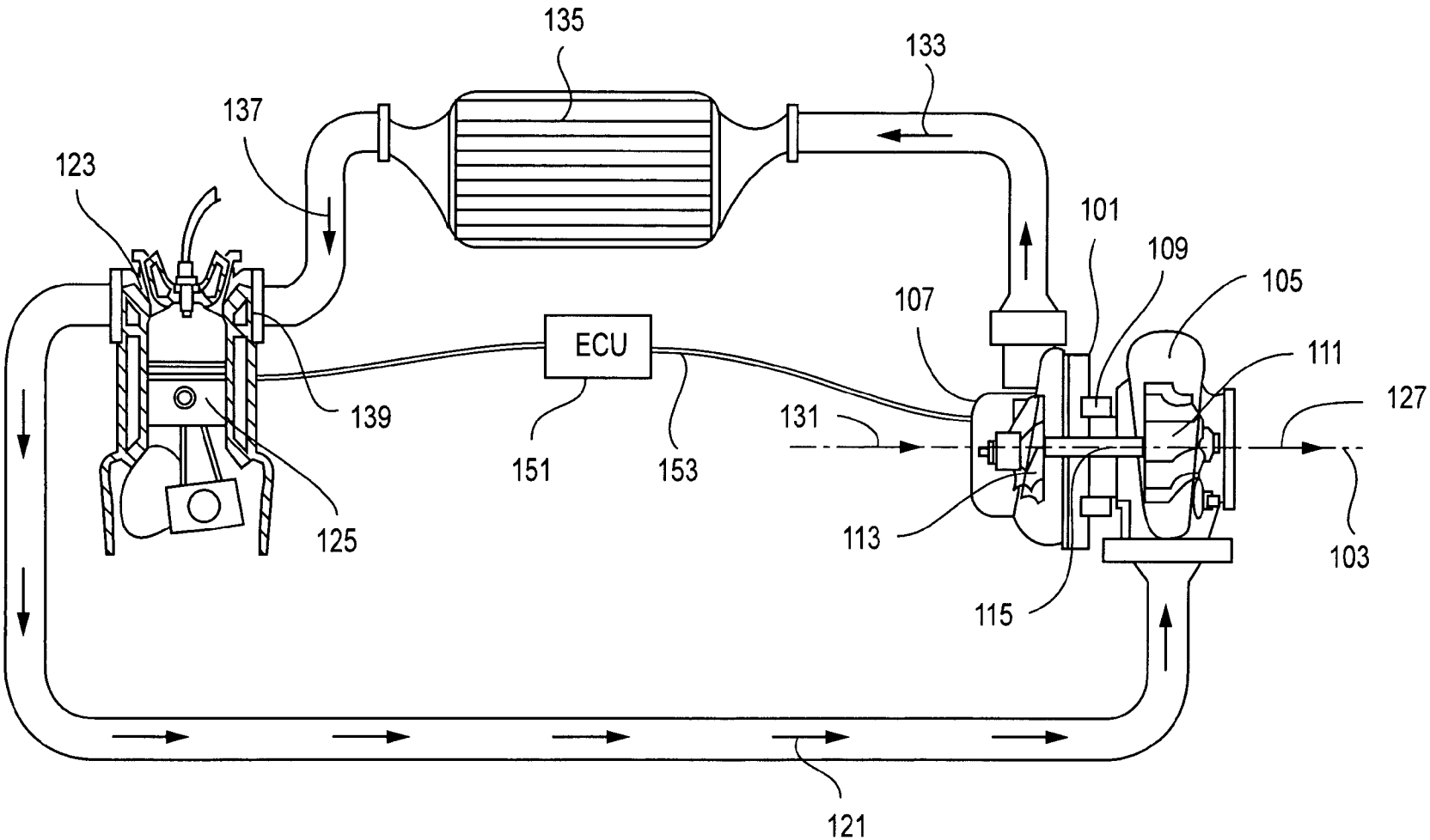
FIG. 2 is a system layout of an internal combustion engine with a turbocharger and a charge air cooler under the present invention.

With reference to FIG. 2, in a first embodiment of the invention, a turbocharger 101 includes a turbocharger housing and a rotor configured to rotate within the turbocharger housing along an axis of rotor rotation 103 on thrust bearings and journal bearings. The turbocharger housing includes a turbine housing 105, a compressor housing 107, and a bearing housing 109 that connects the turbine housing to the compressor housing. The rotor includes a turbine wheel 111 located substantially within the turbine housing, a compressor wheel 113 located substantially within the compressor housing, and a shaft 115 extending along the axis of rotor rotation, through the bearing housing, to connect the turbine wheel to the compressor wheel.

The turbine housing 105 and turbine wheel 111 form a turbine configured to circumferentially receive a high-pressure exhaust gas stream 121 from an exhaust manifold 123 of an internal combustion engine 125. The turbine wheel (and thus the rotor) is driven in rotation around the axis of rotor rotation 103 by the high-pressure exhaust gas stream, which becomes a lower-pressure exhaust gas stream 127 and is axially released into an exhaust system (not shown).

The compressor housing 107 and compressor wheel 113 form a compressor. The compressor wheel, being driven in rotation by the exhaust-gas driven turbine wheel 111, is configured to compress axially received ambient air 131 into a pressurized air stream 133 that is ejected circumferentially from the compressor. The pressurized air stream is characterized by an increased temperature, over that of the ambient air, due to the compression process, but may be channeled through a convectively cooled charge air cooler 135 configured to dissipate heat from the pressurized air stream, and thereby increase its density. The resulting cooled and pressurized air stream 137 is channeled into an intake manifold 139 on the internal combustion engine.

Figure 3:
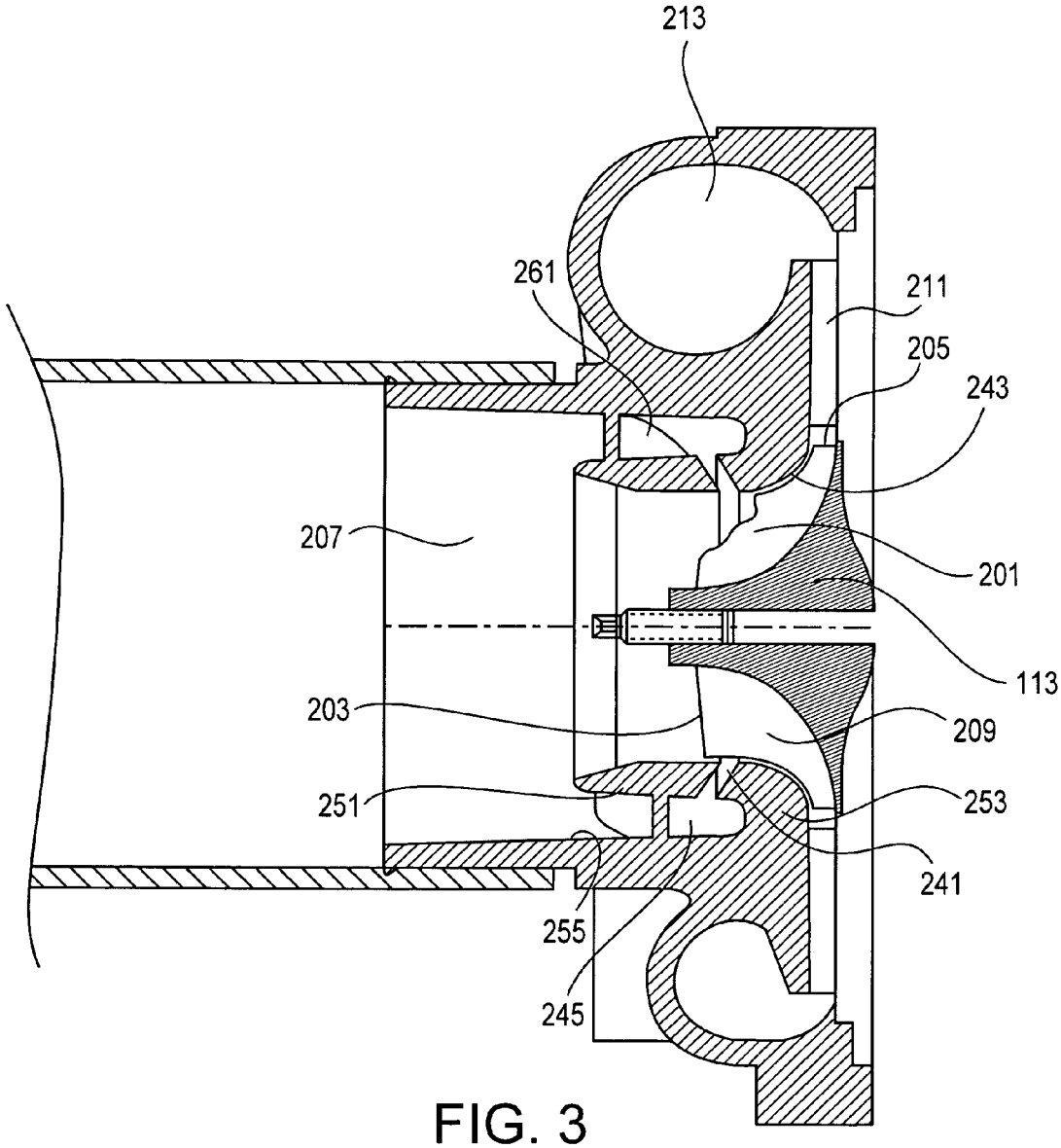
FIG. 3 is a cross-section view of a compressor housing embodying the invention, with an impeller partially cut-away to expose more of an underlying port.

With reference to FIGS. 2 and 3, the compressor wheel 113 includes a plurality of blades 201 (i.e., impellers) that define an inducer 203 (i.e., a typically slightly conical intake area for the combined set of blades, extending between the circular paths of inner and outer edges of the blades' intake ends) and an exducer 205 (i.e., a typically annular output area for the combined set of blades). The compressor housing and compressor wheel form an air passageway, serially including an intake port 207 leading axially into the inducer, an impeller passage 209 leading from the inducer to the exducer and substantially conforming to the space through which the blades rotate, a diffuser 211 leading radially outward from the exducer, and a volute 213 extending around the diffuser. The volute forms a scroll shape, and leads to an outlet port through which the pressurized air stream is ejected circumferentially (i.e., normal to the circumference of the scroll at the exit) as the pressurized air stream 133 that passes to the (optional) charge air cooler and intake manifold. As is typical in automotive applications, the intake port 207 is fed a stream of filtered external air from an intake passage in fluid communication with the external atmosphere. Each of the portions of the passage are in fluid communication with the next.

The compressor housing further defines an annular bypass port 241 opening through a shroud 243 (i.e., a compressor housing wall immediately surrounding and substantially conforming to an outer boundary of the path through which the blades rotate) into the impeller passage 209 between the inducer and exducer. The bypass port places the impeller passage in fluid communication with the intake port 207 through a bypass passageway 245, which is a route that does not extend through the inducer 203.

Similar to a traditional ported shroud, this bypass port improves the surge characteristics of the compressor by routing some air passing through the impeller passage out of the impeller passage during low-airflow operation, thereby extending the range over which the compressor can operate without experiencing a surge condition. However, rather than the compressor housing having axially extending radial ribs, which can straighten the airflow through the bypass passageway to be in a more axial direction, the compressor housing has radial ribs configured to maintain (partially or completely), and possibly even to increase, the non-axial component of non-axial surge airflow.

In the context of this document, it should be understood that the term radial ribs refers to ribs that connect an inner structure with a radially outer structure, such that the rib at any given axial location has a radial component. A radial rib may be purely radial, or may also include a circumferential component at a given axial location. Thus, a radial rib may be a purely radial rib, or may be a "leaned vane" that incorporates radial and circumferential components.

The portion of the compressor housing that forms the shroud 243 is divided by the bypass port into an annular upstream housing-portion 251 and a downstream housing-portion 253. The upstream housing-portion forms an upstream shroud-wall substantially conforming to an upstream portion of the impeller passageway. Likewise, the downstream housing-portion forms a downstream shroud-wall substantially conforming to a downstream portion of the impeller passageway. The downstream housing-portion connects to a substantially cylindrical inlet outer wall 255 that surrounds the upstream housing-portion. The upstream and downstream shroud-walls substantially form the shroud 243.

Figure 4:
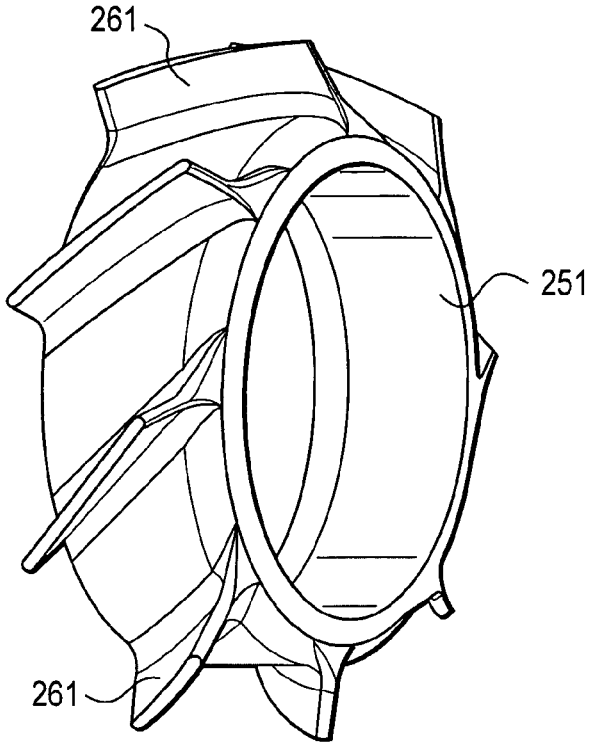
FIG. 4 is a perspective view of an upstream housing-portion with ribs, configured as a separate insert, as used in the compressor housing depicted in FIG. 3.

With reference to FIGS. 3 through 6, the upstream housing-portion 251 may be unitary with the remainder of the compressor housing, or it may be configured as an insert (as depicted in FIG. 4) to be placed within the inlet outer wall 255. A plurality of radial ribs 261 each extend radially across the airflow path of the bypass passageway 245 between the upstream housing-portion 251 and the inlet outer wall 255. The radial ribs support the upstream housing-portion 251 with respect to the downstream housing-portion 253, such that the upstream housing-portion is respectively disposed to form the annular bypass port 241 and bypass passageway 245.

Each rib 261 extends along a non-axial, and preferably helical, path through the bypass passageway. More particularly, the path follows a changing direction having both axial and circumferential components along the bypass passageway. As a result, the bypass passageway forms one or more helical air passages from the bypass port to the intake port. The ribs allow for, and preferably align with, the canted airflow that typically comes from the bypass port and into the bypass passageway of the ported shroud compressor. As a result, the ribs conserve the tangential velocity component of the return-airflow from the bypass port, and thus improve the port's ability to stabilize the flow, while causing less noise than would be caused by an axial rib. As a further result, the direction of the air entering the inducer might also be favorably affected. In this embodiment, the helical angle of the rib, i.e., the angle of the rib as compared to any given plane perpendicular to the axial direction, is constant along the axial length of the rib.

To conserve the tangential velocity component of the return-airflow from the bypass port, the rib must be helically wound to provide for airflow from the bypass port that is angled in the wheel-rotation direction of the compressor wheel. In other words, the wheel rotation direction defines the helical direction of the ribs, taking in the axial direction from the bypass port to the intake port.

Figure 9:
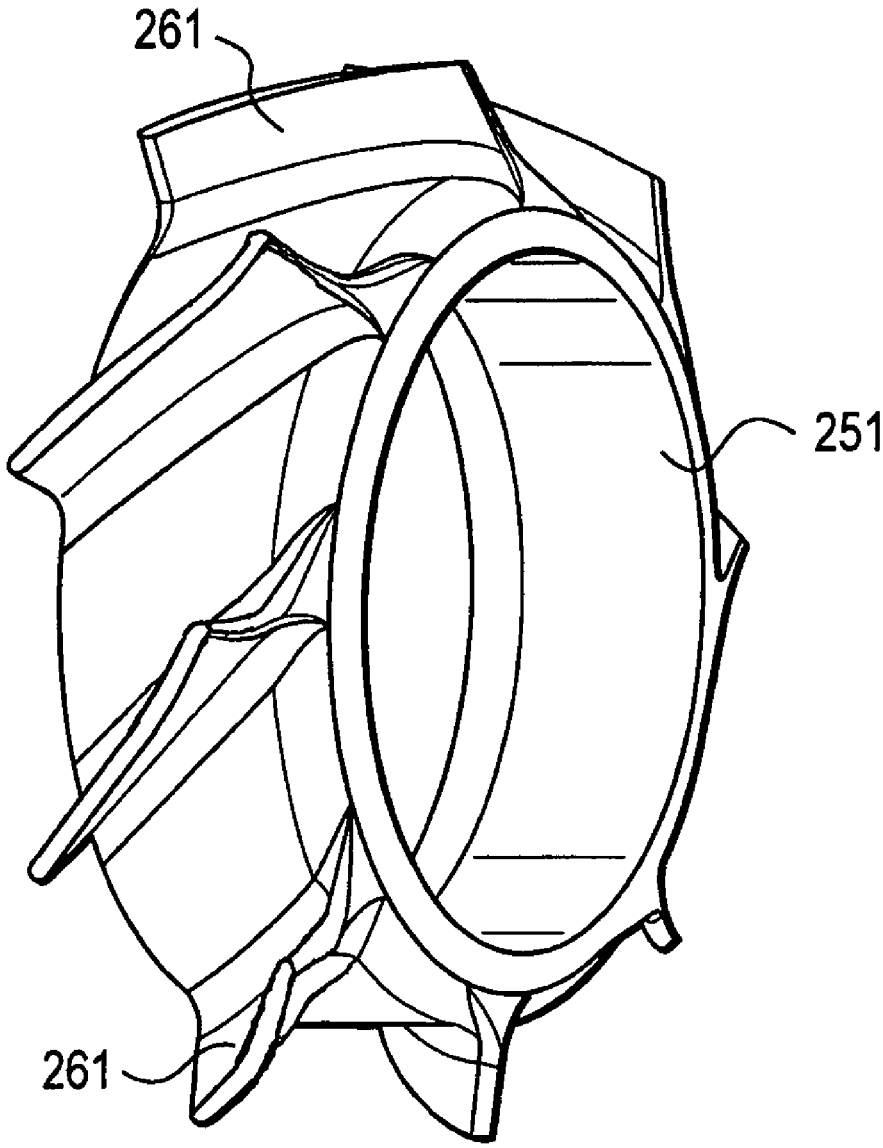
FIG. 9. is a variation of the embodiment of an upstream housing-portion depicted in FIG. 4.

In variations of this embodiment, the helical angle of the rib can vary along the axial length of the rib. In a first such variation (see, e.g., FIG. 9),the angle of the rib 261 of the upstream housing-portion 251 varies from higher values at axial locations closer to the bypass port, to lower values at axial locations more distant from the bypass port (i.e., closer to the intake port). This variation causes the bypass airflow to exit the bypass passageway with a relatively greater circumferential component (with respect to the axial component) than it had when it entered the bypass passageway from the bypass port. In some cases, the greater circumferential component will decrease interference between bypass air returning to the intake port and external air entering the intake port. In a second variation, the angle varies from lower values at axial locations closer to the bypass port, to higher values at axial locations more distant from the bypass port.

While as few as one rib could conceivably be used, the use of multiple ribs is anticipated to be more typical. Moreover, in applications where the ribs will be used to turn the airflow, larger numbers of ribs may provide for more accurate control of airflow direction. Thus, while two, three or four ribs might be structurally adequate to support the upstream housing-portion, it may be desirable to use eight, twelve, or even larger numbers of ribs.

In operation, the rib supports the upstream housing-portion with respect to the downstream housing-portion such that they are respectively disposed to form the annular bypass port into the impeller passageway between the upstream and downstream shroud-walls, this step of supporting being conducted such that the circumferential component of non-axial surge airflow through the annular bypass port is not substantially reduced with respect to the axial component of non-axial flow. Moreover, in operation the rib preferably does not substantially obstruct the proportion of circumferential airflow with respect to the proportion of axial airflow. Instead, it preferably guides non-axial surge airflow in a non-axial direction through the annular bypass port to at least partially maintain its circumferential component, while the rib supports the upstream housing-portion with respect to the downstream housing-portion such that they are respectively disposed to form the annular bypass port into the impeller passageway between the upstream and downstream shroud-walls.

The use of inclined ribs may improve surge efficiency by encouraging circumferential flow in air received from the bypass port. Additionally, similar to a traditional ported shroud, the bypass port may improve the choke characteristics of a compressor by providing an additional flow path into the impeller passage without passing through the inducer, during high-airflow operation, thereby extending the range over which the compressor can operate without experiencing a choke condition. In this case, the inclined ribs cause and/or increase helical motion in a direction opposite the wheel-rotation direction, potentially increasing the intake of air. These advantages are potentially had without the additional noise caused by helical airflow impinging on axial ribs.

The advantages provided by the above-described inclined ribs 261 may be augmented with the use of a noise suppressor 271 upstream from the upstream housing-portion 251. The noise suppressor includes an intake surface 273 configured to direct air entering the compressor housing into the inducer, rather than allowing it to impinge on the bypass passageway. The noise suppressor further includes a bypass surface 275 configured to direct air from the bypass port into the intake port in a direction having an increased radial component, and having an axial component that is either decreased in magnitude, or inverted so as to not axially impinge on external air are being received into the compressor housing. If the upstream housing-portion is configured as a separate insert, the noise suppressor may be configured as a retaining ring to retain the upstream housing-portion in place.

Figure 5:
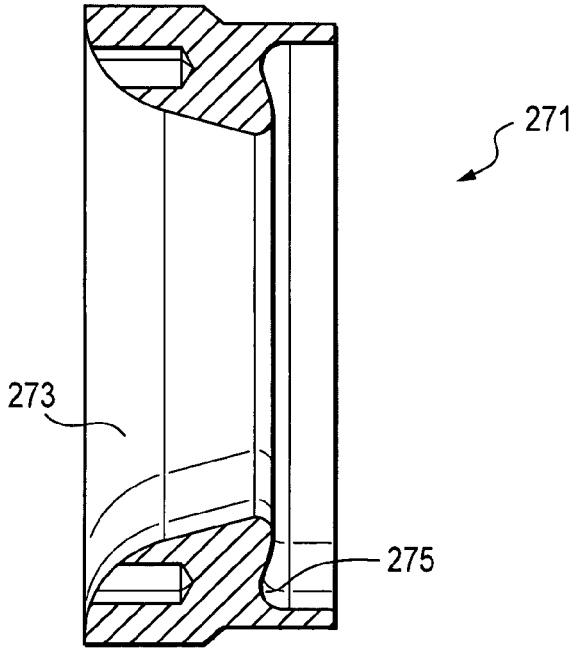
FIG. 5 is a cross-section view of a retaining ring noise suppressor, to be used in conjunction with the compressor housing depicted in FIG. 3.
Figure 6:
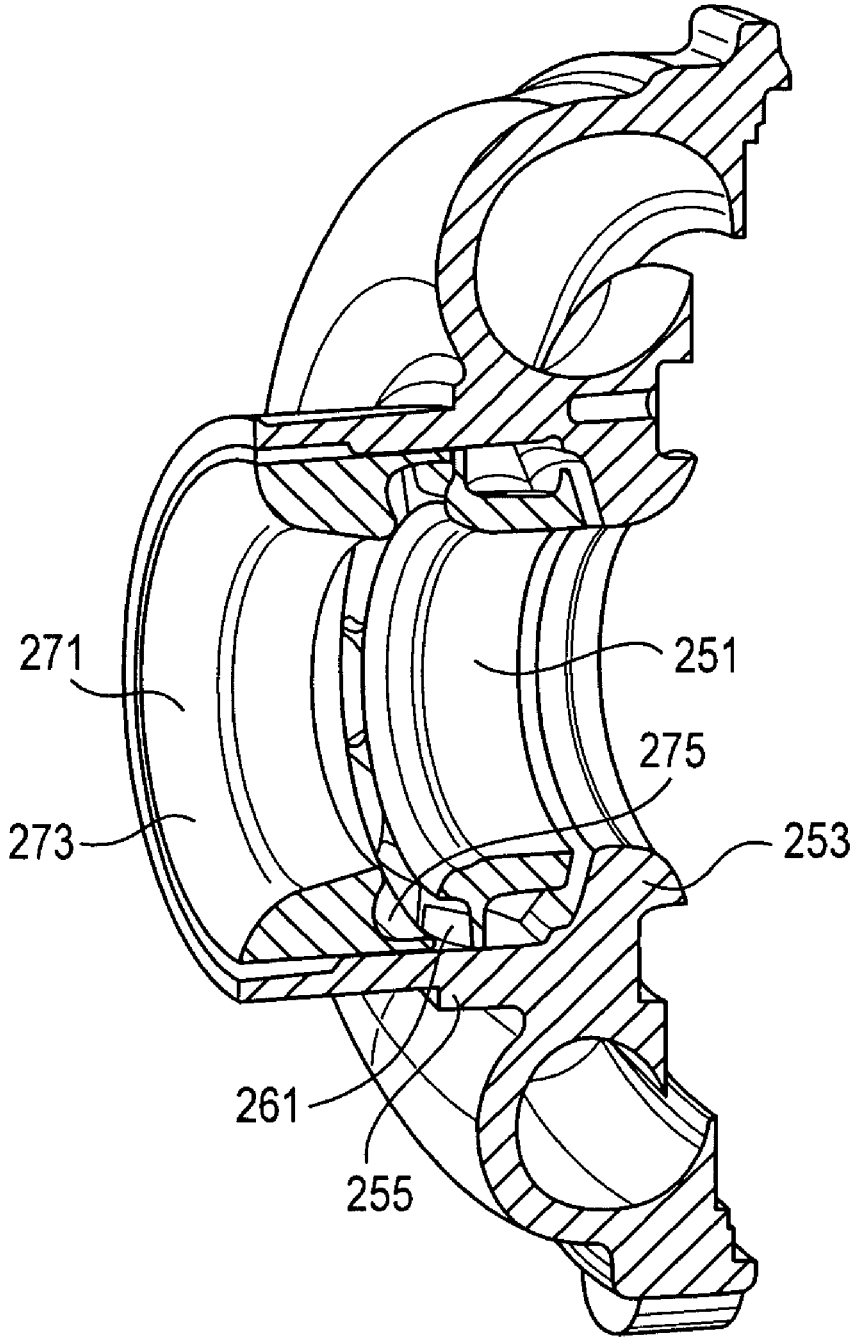
FIG. 6 is a cross-section perspective view of the compressor housing depicted in FIG. 3, with the noise suppressor depicted in FIG. 5.
Figure 7:
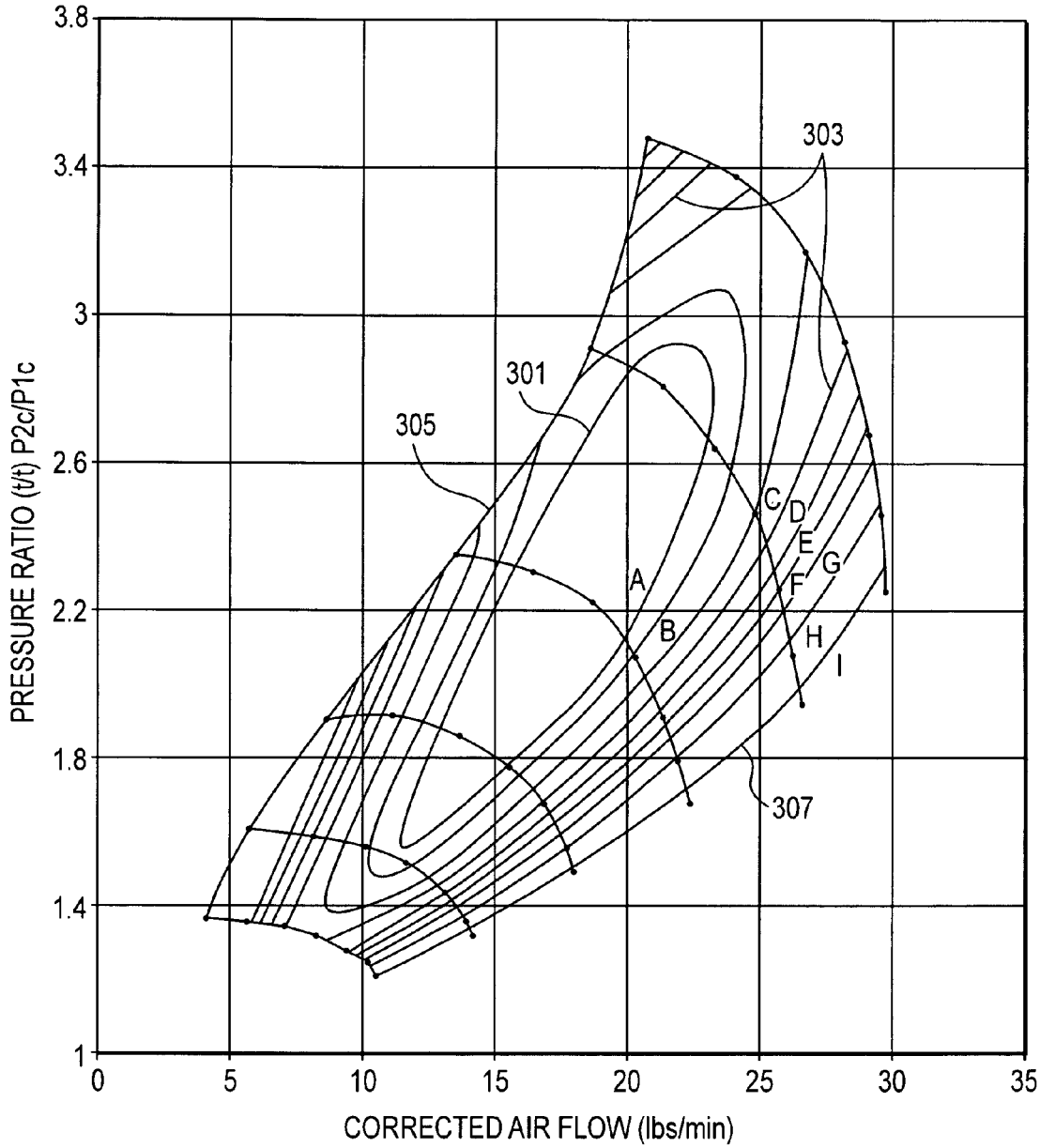
FIG. 7 is a flow diagram depicting the performance of an experimental turbocharger under the present invention.

With reference to FIG. 7, the performance of an experimental turbocharger configured with helically extending ribs was tested, and the results of that test were plotted in a flow diagram. The experimental turbocharger included an insert forming an upstream housing-portion that was unitary with the helically extending ribs (as depicted in FIG. 4), and a retaining ring configured as a noise suppressor (as depicted in FIG. 5). As is known for compressor technology, the results were plotted as a topographical map representing various percentage levels of compressor performance (denoted with the characters A through I in descending order).

For example, curve A 301 represents a range of compressor operating conditions (i.e., combinations of airflow rates and compressor fresher ratios) for which the helical-rib compressor operates at a high percentage efficiency level, while curve D 303 represents a range of compressor operating conditions for which the helical-rib compressor operates at a relatively lower percentage efficiency level. These results are bounded by a surge line 305 and a choke line 307, which represent the limits at which a surge condition and a choke condition occurs, respectively.

Figure 8:
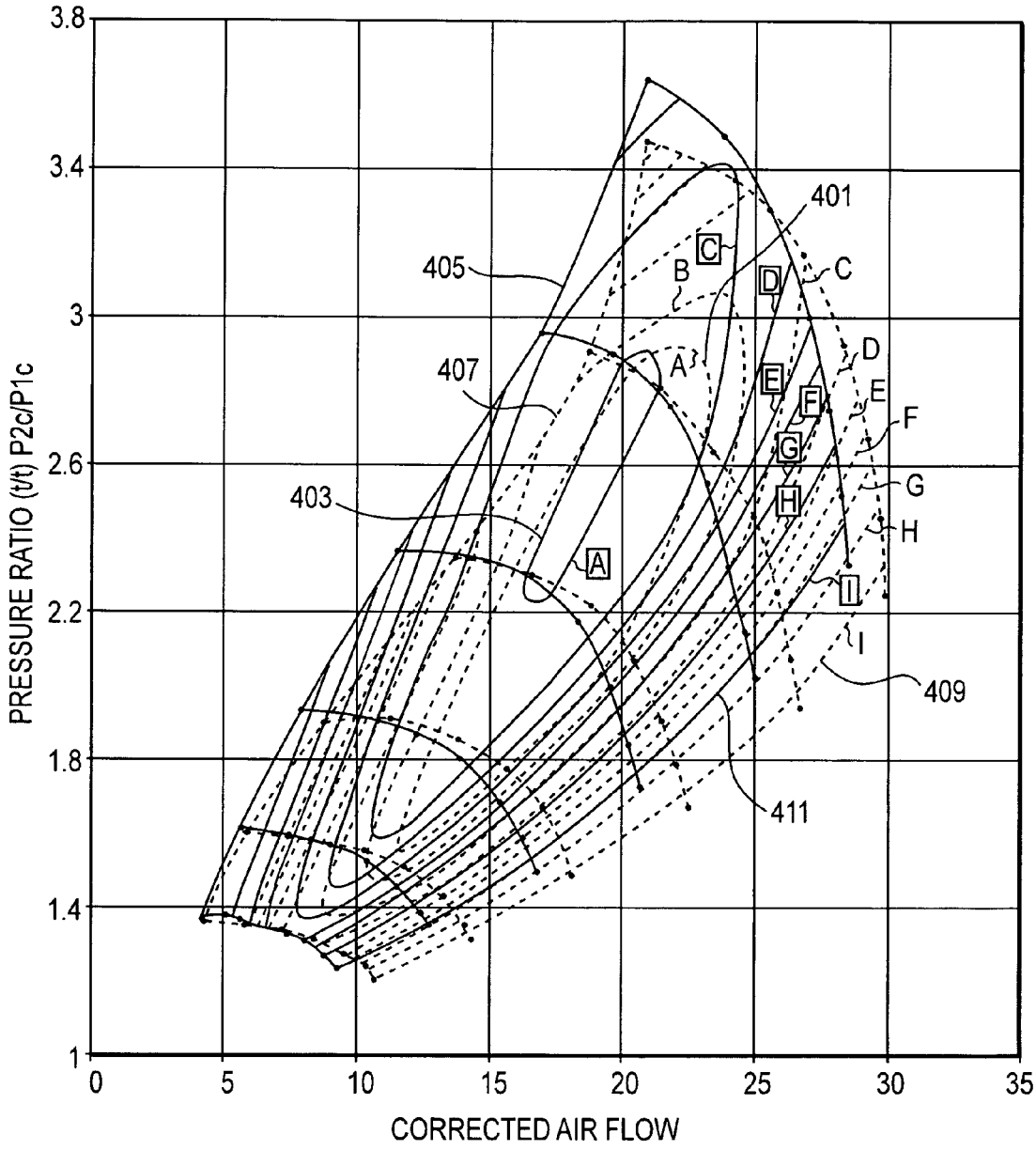
FIG. 8 is a pair of flow diagrams comparing the performance depicted in FIG. 7 to a turbocharger configured with axially extending radial ribs.

With reference to FIG. 8, the helical-rib compressor performance data plotted in FIG. 7 was compared to the performance of a compressor that differed only in the form of the insert. In particular, the insert used to develop the additional data depicted in FIG. 7 was replaced with a similar insert having axially extending ribs. In FIG. 8, the performance data for the axial-rib compressor is plotted using solid lines, while the helical-rib compressor data from FIG. 7 is replicated using dotted lines. These topographical maps use like characters (A through I) to denote like efficiency levels, while the characters for the axial rib data are identified with a surrounding box.

The experimental data shows that helically extending ribs provide a strong increase in the range of flow conditions that exhibit performance level A, the highest level measured in the experiment. More particularly, the A performance level area 401 for the helical-rib compressor is vastly larger than the A performance level area 403 for the axial-rib compressor. Similar results appear to occur at other performance levels.

In the figure, it appears that the axial-rib compressor surge line 405 is preferable to the helical-rib compressor surge line 407, while the helical rib compressor choke line 409 is preferable to the axial-rib compressor choke line 411. Nevertheless, the compressor trim, which provides a measure of the inlet diameter to the outlet diameter, may be adjusted (i.e., trimmed), which as a general rule causes the flow diagram to translate to the right (for a larger trim) or to the left (for a smaller trim). As a result, what is important is not the physician, but rather the size and shape of the flow diagram. It appears that in this case, the flow diagrams are similar in size, with the radial-rib compressor being preferable in several aspects.

It is to be understood that the invention further comprises related apparatus and methods for designing turbocharger systems and for producing turbocharger systems, as well as the apparatus and methods of the turbocharger systems themselves. In short, the above disclosed features can be combined in a wide variety of configurations within the anticipated scope of the invention.

While particular forms of the invention have been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the scope of the invention. Accordingly, the invention is not intended to be limited by the above discussion, and is defined with reference to the following claims.

What is claimed is:

1. A compressor housing configured to contain a rotating wheel-body with a plurality of blades that define an impeller passageway from an inducer to an exducer, through which the plurality of blades are configured to rotate, comprising:

an annular upstream housing-portion forming an upstream shroud-wall substantially conforming to an upstream portion of the impeller passageway;

a downstream housing-portion forming a downstream shroud-wall substantially conforming to a downstream portion of the impeller passageway; and a rib supporting the upstream housing-portion with respect to the downstream housing-portion such that they are respectively disposed to form an annular bypass port connecting an axially extending bypass passageway and the impeller passageway between the upstream and downstream shroud-walls, the rib extending along a helical path along the axial extent of the bypass passageway.

2. The compressor housing of claim 1, wherein the helical path of the rib defines a constant angle to planes perpendicular to the axial direction.

3. The compressor housing of claim 1, wherein the helical path of the rib defines a varying angle to planes perpendicular to the axial direction, such that the angle is greater for planes closer to the bypass port.

4. The compressor housing of claim 1, wherein the compressor wheel is configured to rotate in a wheel-rotation direction, and wherein the rib is helically wound to provide for airflow from the bypass port that is angled in the wheel-rotation direction.

5. The compressor housing of claim 1, wherein the rib extends radially across the bypass passageway.

6. The compressor housing of claim 1, wherein:

the helical path defines a constant angle to planes perpendicular to the axial direction;

the compressor wheel is configured to rotate in a wheel-rotation direction;

the rib is helically wound to provide for airflow from the bypass port that is angled in the wheel-rotation direction; and the rib extends radially across the bypass passageway.

7. A compressor, comprising:

the compressor housing of claim 1; and a compressor wheel configured as the wheel-body, and being rotatably received within the compressor housing.

8. A turbocharger, comprising:

the compressor of claim 7; and a turbine configured to drive the compressor.

9. A power system, comprising:

an internal combustion engine; and the turbocharger of claim 8, being configured to operate with the internal combustion engine.

10. A method of compressing air, comprising:

driving a compressor wheel in rotation within a compressor housing, the compressor wheel having a plurality of blades that define an impeller passageway from an inducer to an exducer, through which the plurality of blades are configured to rotate, wherein an annular upstream housing-portion of the compressor housing forms an upstream shroud-wall substantially conforming to an upstream portion of the impeller passageway, wherein a downstream housing-portion of the compressor housing forms a downstream shroud-wall substantially conforming to a downstream portion of the impeller passageway; and supporting the upstream housing-portion with respect to the downstream housing-portion such that they are respectively disposed to form an annular bypass port connecting an axially extending bypass passageway and the impeller passageway between the upstream and downstream shroud-walls, the step of supporting being conducted with structure that extends along a helical path along the axial extent of the bypass passageway such that the structure does not obstruct circumferentially moving surge airflow through the bypass passageway.

* * * * *